US011466389B2

(12) United States Patent
Park

(10) Patent No.: US 11,466,389 B2
(45) **Date of Patent: *Oct. 11, 2022**

(54) WASHING APPARATUS AND CONTROL METHOD THEREOF

(71) Applicant: LG ELECTRONICS INC., Seoul (KR)

(72) Inventor: Yun Sik Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 311 days.

This patent is subject to a terminal disclaimer.

(21) Appl. No.: 16/701,100

(22) Filed: Dec. 2, 2019

(65) Prior Publication Data

US 2021/0102329 A1 Apr. 8, 2021

(30) Foreign Application Priority Data

Oct. 2, 2019 (KR) ..... 10-2019-0122312

(51) Int. Cl.

| | |
|---|---|
| ***D06F 39/00*** | (2020.01) |
| ***D06F 34/18*** | (2020.01) |
| ***D06F 33/00*** | (2020.01) |
| *D06F 103/02* | (2020.01) |

(52) U.S. Cl.
CPC ..... *D06F 34/18* (2020.02); *D06F 33/00* (2013.01); *D06F 2103/02* (2020.02)

(58) Field of Classification Search
CPC ..... D06F 34/18; D06F 33/00; D06F 2103/02; D06F 2103/04; D06F 2103/06; D06F 2103/08; D06F 2103/16; D06F 39/00; D06F 39/045; D06F 39/04; D06F 35/00; D06F 35/001; D06F 35/002; D06F 35/003; D06F 35/004; D06F 35/005; D06F 35/006; D06F 35/007; D06F 35/008
USPC ..... 8/158
See application file for complete search history.

(56) References Cited

U.S. PATENT DOCUMENTS

2004/0060123 A1* 4/2004 Lueckenbach ..... D06F 34/14 68/12.02

FOREIGN PATENT DOCUMENTS

| | | |
|---|---|---|
| KR | 19990065538 | 8/1999 |
| KR | 1020060061319 | 6/2006 |

* cited by examiner

*Primary Examiner* — Tinsae B Ayalew
(74) *Attorney, Agent, or Firm* — Lee, Hong, Degerman, Kang & Waimey PC

(57) ABSTRACT

Disclosed are a washing apparatus and a control method thereof using an artificial intelligence (AI) algorithm and/or a machine learning algorithm in a 5G environment connected for Internet of things (IoT). A washing apparatus including a container in which laundry is accommodated includes a controller, a motor electrically connected to the controller and configured to rotate the container, a weight sensor electrically connected to the controller and configured to measure a weight of the laundry accommodated in the container, and a current sensor electrically connected to the controller and configured to measure a current value applied to the motor.

13 Claims, 4 Drawing Sheets

WASHING APPARATUS AND CONTROL METHOD THEREOF

CROSS-REFERENCE TO RELATED APPLICATION

This present application claims benefit of priority to Korean Patent Application No. 10-2019-0122312, entitled "WASHING APPARATUS AND CONTROL METHOD THEREOF" filed on Oct. 2, 2019, in the Korean Intellectual Property Office, the entire disclosure of which is incorporated herein by reference.

BACKGROUND

1. Technical Field

The present disclosure relates to a washing apparatus and a control method thereof, and more particularly, to a washing apparatus and a control method thereof for artificial intelligence model learning.

2. Description of Related Art

Description of this section only provides the background information of embodiments, and does not constitute related art A washing apparatus processes laundry through various operations such as washing, rinse, spin-dry, and/or dry. Such a laundry processing apparatus includes a container that is rotated by a motor and accommodates laundry, for example, a washing tank.

When a washing apparatus is not capable of accurately measuring the amount of laundry, a spin-dry operation performed at high speed takes a significant amount of time, and thus there is a shortcoming in that a total washing time increases and energy consumption therefrom increases. Accordingly, diverse research is being conducted regarding methods of accurately detecting the amount of laundry.

In general, a laundry processing apparatus has an algorithm installed therein to detect the amount of laundry put into the washing tank.

Korean Patent Application Publication No. 10-2006-0061319 discloses a method of detecting the amount of laundry by accelerating a motor speed to a predetermined revolutions per minute and then calculating information on an offset acquired during constant velocity control, a direct current (DC) voltage, or a motor torque value.

Korean Patent Application Publication No. 1999-0065538 discloses a method of detecting the amount of laundry by measuring a time taken to accelerate a motor while accelerating the motor at a preset speed and a variation in a rotation speed of the motor while rotating the motor at the preset speed.

The washing apparatus may perform a dry operation on wet laundry after washing is completed. An operation time, power consumption, or the like of the dry operation of laundry may be changed depending on output of a motor included in the washing apparatus, the weight of the laundry, or the like, as well as the amount of the laundry.

Accordingly, when the amount of laundry, the output of the motor, or the weight of laundry differs, it is required to recognize an appropriate timing of terminating a dry operation in order to effectively perform the dry operation.

Recently, interest in machine learning such as artificial intelligence or deep learning has largely increased. Existing machine learning mainly uses statistics-based classification, regression, and clustering models.

In particular, in supervised learning of a classification and regression model, a human predefines the properties of learning data and a learning model for identifying new data based on these properties. In contrast, in deep learning, a computer autonomously finds and determines the properties.

In deep learning, extraction and selection of a learning process, a learning method, and data used in learning as well as deep learning algorithms are becoming increasingly important for effective learning and recognition. Further, research regarding the use of artificial intelligence and machine learning in various products and services is increasing.

SUMMARY OF THE INVENTION

An aspect of the present disclosure is to provide a washing apparatus and a control method thereof for recognizing a time point of terminating a dry operation of laundry via artificial intelligence model learning.

Another aspect of the present disclosure is to provide setting of an input factor inputted to an artificial neural network for artificial intelligence model learning in order to recognize a time point of terminating a dry operation of a washing apparatus.

Another aspect of the present disclosure is to provide setting of a condition for terminating a dry operation, that is, a set condition and a detailed method of artificial intelligence model learning for deriving the set condition.

Aspects of the present disclosure are not limited to the aspects described above, and other aspects that are not stated herein will be clearly understood by those skilled in the art from the following description.

According to an embodiment, a washing apparatus including a container in which laundry is accommodated may include a controller, a motor electrically connected to the controller and configured to rotate the container, a weight sensor electrically connected to the controller and configured to measure a weight of the laundry accommodated in the container, and a current sensor electrically connected to the controller and configured to measure a current value applied to the motor.

The controller may stop an operation of the motor and may terminate a dry operation of the laundry when a dried state of the laundry satisfies a set condition, and the set condition for the dried state of the laundry may be derived via learning according to an artificial intelligence model based on output of the motor, a changing trend of the current value of the motor over time, and the weight of the laundry.

The set condition may be a state in which the current value of the motor is maintained at a set value or less.

The controller may be connected to a processor configured to derive a current setting value of the motor. The processor may perform learning according to the artificial intelligence model, and may receive an input factor and derive the current setting value using the received input factor.

The input factor may include the output of the motor, the weight of the laundry accommodated in the container, and a first current pattern defined as a current pattern of the motor when the container in which the laundry is accommodated is rotated, in a state prior to water supply.

The current setting value may be a value derived based on conditions depending on a change in at least one of the output of the motor, the weight of the laundry, or the first current pattern in the state prior to water supply in a learning mode according to the artificial intelligence model.

The current setting value may be set to be higher than a maximum current value of the first current pattern.

The controller may stop the operation of the motor and may terminate the dry operation of the laundry when a maximum current value of a second current pattern defined as a current pattern of the motor when the container is rotated for drying the laundry, in a state after water supply, is maintained at the current setting value or less.

The maximum current value of the second current pattern may be higher than the maximum current value of the first current pattern at a time point at which the operation of the motor is stopped.

The output of the motor when the container is rotated prior to water supply and the output of the motor when the container is rotated for drying the laundry may be the same.

The washing apparatus may further include a transceiver configured to communicate with a server, and the processor may be included in the server.

The controller may receive information on the current setting value from the server.

The washing apparatus may further include a memory configured to store information on the current setting value, and the controller may select the current setting value based on the information on the current setting value stored in the memory.

The processor may perform learning on classification of a new first current pattern according to the artificial intelligence model.

According to another embodiment, a control method of a washing apparatus may include rotating a container in which laundry is accommodated using a motor, collecting a current pattern indicting a changing trend of a current value of the motor over time, supplying water to the container and washing the laundry, and drying the laundry.

A controller included in the washing apparatus may stop an operation of the motor and may terminate a dry operation of the laundry when a dried state of the laundry satisfies a set condition, and the set condition for the dried state of the laundry may be derived via learning according to an artificial intelligence model based on output and a current pattern of the motor, and a weight of the laundry.

The set condition may be a state in which the current value of the motor is maintained at a set value or less, the controller may be connected to a processor configured to derive a current setting value of the motor. The processor may perform learning according to the artificial intelligence model, and may receive an input factor and derive the current setting value using the received input factor.

The input factors may include the output of the motor, the weight of the laundry accommodated in the container, and a first current pattern defined as a current pattern of the motor when the container in which the laundry is accommodated is rotated, in a state prior to water supply, and the controller may stop the operation of the motor and may terminate the dry operation of the laundry when a maximum current value of a second current pattern defined as a current pattern of the motor when the container is rotated for drying the laundry, in a state after water supply, is maintained at the current setting value or less.

The maximum current value of the second current pattern may be higher than the maximum current value of the first current pattern at a time point at which the operation of the motor is stopped, and output of the motor when the container is rotated prior to water supply and output of the motor when the container is rotated for drying the laundry may be the same.

According to embodiments of the present disclosure, the dry operation of the laundry may be controlled using the current setting value derived via artificial intelligence model learning, and thus convenience of the dry operation of the laundry may be enhanced compared with the case in which a separate humidity sensor is used.

According to the embodiments, in order to recognize a dried state of the laundry, it is not required to use a separate humidity sensor, and thus costs may be advantageously reduced.

When the separate humidity sensor is used, a dried state of the laundry differs and may be inaccurately recognized depending on an arrangement position of the humidity sensor, but since the dried state of the laundry may be recognized via artificial intelligence model learning, the accuracy of the dry operation of the laundry may be enhance.

BRIEF DESCRIPTION OF THE DRAWINGS

The above and other aspects, features, and advantages of the present disclosure will become apparent from the detailed description of the following aspects in conjunction with the accompanying drawings, in which:

FIGS. 3 to 5 are obtained via tests in which the output of the motor differs in each test and the weights of laundry are 1 kg, 3 kg, and 5 kg, respectively;

DETAILED DESCRIPTION

Figure 1:
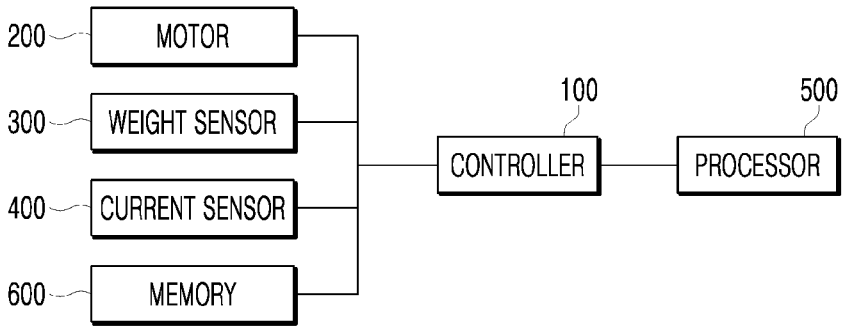
FIG. 1 is a diagram for explaining a washing apparatus according to an embodiment.

Hereinbelow, embodiments will be described in greater detail with reference to the accompanying drawings. The embodiments may be modified in various ways and may have various forms, and specific embodiments will be illustrated in the drawings and will be described in detail herein. However, this is not intended to limit the embodiments to the specific embodiments, and the embodiment should be understood as including all modifications, equivalents, and replacements that fall within the spirit and technical scope of the embodiments.

Terms such as "first," "second," and other numerical terms when used herein do not imply a sequence or order unless clearly indicated by the context. These terms are only used to distinguish one element from another. In addition, terms, which are specially defined in consideration of the configurations and operations of the embodiments, are given only to explain the embodiments, and do not limit the scope of the embodiments.

In the description of the embodiment, in the case in which it is described as being formed on "on" or "under" of each element, "on" or "under" includes two elements directly contacting each other or one or more other elements being indirectly formed between the two elements. In addition, when expressed as "on" or "under", it may include not only upwards but also downwards with respect to one element.

Further, relational terms to be described below such as "on/over/up" and "beneath/under/down" may be used to discriminate any one subject or element from another subject or element without necessarily requiring or comprehending a physical or logical relationship or sequence of subjects or elements.

FIG. 1 is a diagram for explaining a washing apparatus according to an embodiment. The washing apparatus may include a container for accommodating laundry. The container may be rotatably configured. The washing apparatus may wash or dry laundry while rotating the laundry.

The washing apparatus may include a controller 100, a motor 200, a weight sensor 300, and a current sensor 400. The controller 100 may control an operation of the motor 200 to perform a wash or dry operation on laundry.

The motor 200 may be electrically connected to the controller 100 and may rotate the container. A rotary shaft of the motor 200 may be coupled to the container, and when the motor 200 is operated, the container may be rotated.

The motor 200 may be operated under control of the controller 100, and thus the controller 100 may control output of the motor 200. The controller 100 may control the motor 200 such that the output of the motor 200 changes depending on the weight of laundry accommodated in the container.

The output of the motor 200 may be appropriately set depending on the weight of laundry. Even when the weight of the laundry does not differ, the controller 100 may control the output of the motor 200 differently. Thus, in artificial intelligence model learning that will be described below, the output of the motor 200 and the weight of the laundry may be independent input factors.

The weight sensor 300 may be electrically connected to the controller 100, and may measure the weight of the laundry accommodated in the container. For example, the weight sensor 300 may be installed inside the container or at a portion adjacent to the container. Information on the weight of the laundry measured by the weight sensor 300 may be transmitted to the controller 100.

The current sensor 400 may be electrically connected to the controller 100, and may measure a current value applied to the motor 200. For example, the current sensor 400 may be installed inside the motor 200 or at a portion adjacent to the motor 200. Information on a current value of the motor 200 measured by the current sensor 400 may be transmitted to the controller 100.

The controller 100 may continuously receive the measured current value of the motor 200 from the current sensor 400, and may recognize a current pattern indicating a changing trend of the current value of the motor 200 over time.

The controller 100 may control the output of the motor 200, and may thus autonomously recognize output applied to the motor 200.

The controller 100 may be communicably connected to a processor 500. The processor 500 may be included in the washing apparatus or a server, which will be described below in detail.

The washing apparatus may further include a memory 600 for storing information on a current setting value Is, which will be described below in detail.

In order to remove moisture on completely washed laundry, the controller 100 may rotate the motor 200 to perform a dry operation of the laundry. In this case, when the laundry reaches a dried state that satisfies a user, the controller 100 may terminate the dry operation.

According to embodiments, when a set condition is satisfied, it may be deemed that the laundry has reached the dried state that satisfies the user. Thus, when the dried state of the laundry satisfies the set condition, the controller 100 may stop an operation of the motor 200 and may terminate the dry operation of the laundry.

The set condition for the dried state of the laundry may be derived by learning according to an artificial intelligence model based on the output and current pattern of the motor 200, and the weight of the laundry.

The set condition may correspond to the state in which the current value of the motor 200 is maintained at a setting value, that is, the current setting value Is or less.

Figure 2:
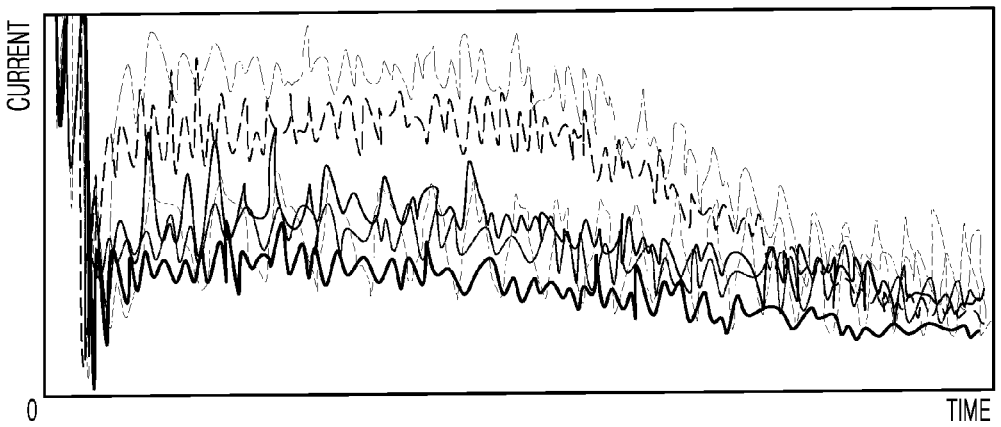
FIG. 2 is a graph showing a second current pattern of a motor according to an embodiment. The plots in FIG. 2 illustrate scenarios in which the output of the motor and the weight of laundry are different from each other.

FIG. 2 is a graph showing a second current pattern of the motor 200 according to an embodiment. The plots in FIG. 2 illustrate scenarios in which the output of the motor 200 and the weight of laundry are different from each other.

FIG. 2 shows the test results, and the second current pattern is obtained by recording a current value applied to the motor 200 over time while the motor 200 is operated to dry wet laundry after washing is completed. The graph shows the second current pattern, that is, a current pattern of the motor 200 when the container is rotated in order to dry the laundry in the state after water supply.

As seen from the second current pattern, the current value abruptly changes at an early stage of the dry operation. This is because laundry is concentrated at a specific portion of the container and an operation of the motor 200 is not in a steady state at the early stage of the dry operation.

Thereafter, it may be seen that the current value changes within a relatively stable range. However, the current value is relatively large compared with the current value at a later stage of the dry operation. This is because at the early stage of the dry operation the laundry contains a relatively large amount of water and is heavier than when in a dried state, and the laundry is positioned close to a wall at an edge of a container, which results in a high load being applied to the motor 200 and thus a high current consumption.

The current value is relatively low in the later stage of the dry operation compared with a previous stage. This is because at the later stage of the dry operation the load applied to the motor 200 is reduced due to the fact that moisture of the laundry is reduced as the laundry is gradually dried, and that the laundry is not positioned close to the edge of the container.

As seen from the second current pattern, a maximum current value of the motor 200 is gradually reduced as the dry operation proceeds, and the maximum current value is maintained at a relatively constant value at a time point when the laundry is completely dried.

Thus, when a value similar to the maximum current value at the time point when the laundry is completely dried is defined as the current setting value Is, and when a state in which the current value of the motor 200 is maintained at the current setting value Is or less is reached, the controller 100 may stop an operation of the motor 200 and may terminate the dry operation of the laundry.

Referring to FIG. 2, the current value applied to the motor 200 may be increased as the weight of the laundry and the output of the motor 200 are increased during the dry operation. Comparing the plots shown in FIG. 2, the upper plots having a high current value may indicate that the motor 200 is operating in a state in which the laundry is heavy or the output of the motor 200 is high, compared with the lower plots having a small current value.

Hereinafter, with reference to FIGS. 3 to 5, the current setting value Is will be described in detail.

Figure 3:
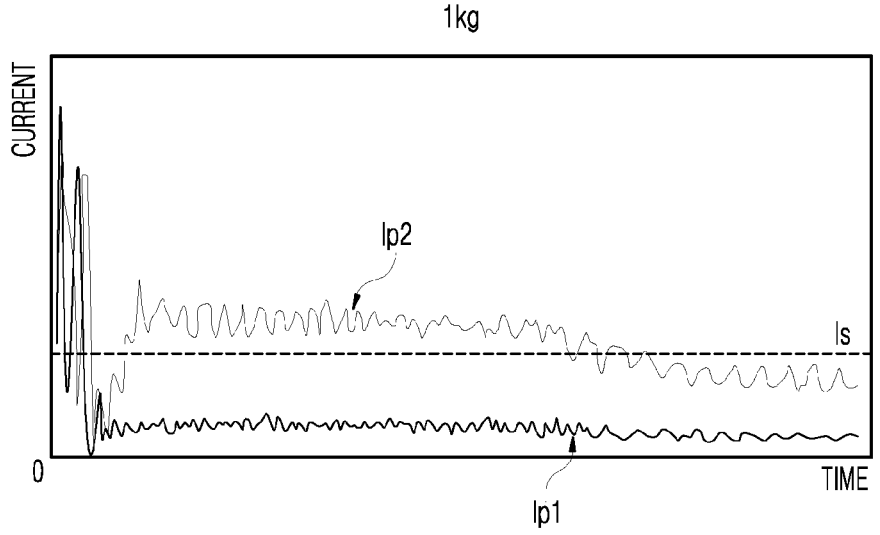
FIG. 3 is a graph showing a first current pattern and a second current pattern of a motor according to an embodiment.

FIG. 3 is a graph showing a first current pattern Ip1 and a second current pattern Ip2 of the motor 200 according to an embodiment.

Figure 4:
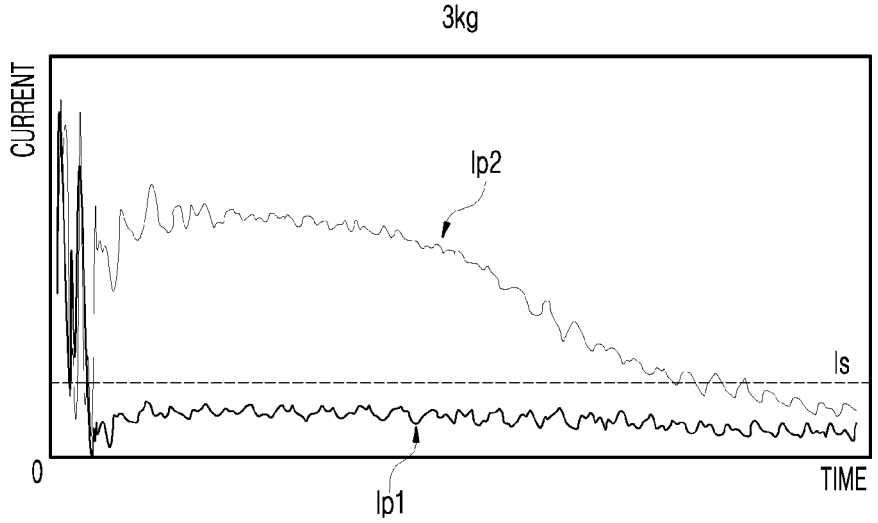
FIG. 4 is a graph showing a first current pattern and a second current pattern of a motor according to another embodiment.

FIG. 4 is a graph showing the first current pattern Ip1 and the second current pattern Ip2 of the motor 200 according to another embodiment.

Figure 5:
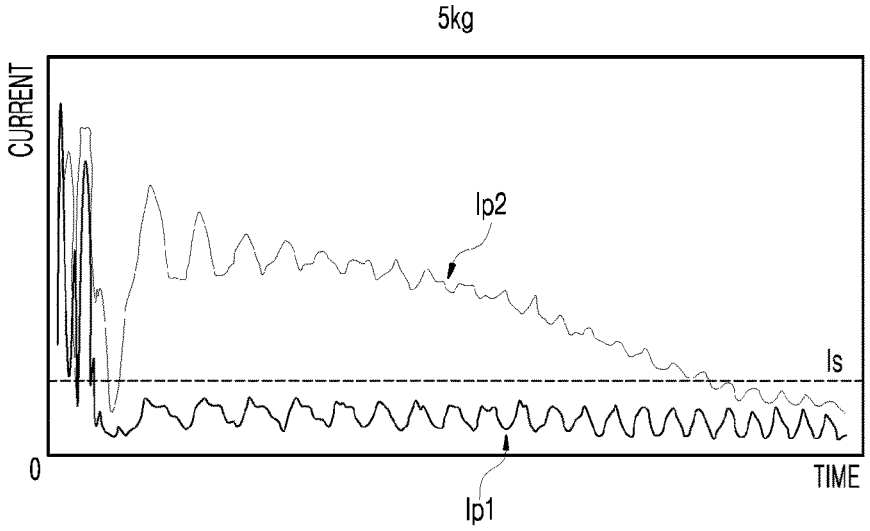
FIG. 5 is a graph showing a first current pattern and a second current pattern of a motor according to yet another embodiment.

FIG. 5 is a graph showing the first current pattern Ip1 and the second current pattern Ip2 of the motor 200 according to yet another embodiment.

FIGS. 3 to 5 are obtained via tests in which the output of the motor 200 differs in each test and the weights of laundry are 1 kg, 3 kg, and 5 kg, respectively. In each of the test results shown in FIGS. 3 to 5, the output of the motor 200 and the weight of the laundry are fixed. In FIGS. 3 to 5, the weight of the laundry is a value before water for washing laundry is supplied, that is, before washing is performed.

Referring to FIG. 3, the first current pattern Ip1 is a current pattern of the motor 200 when the container in which the laundry is accommodated is rotated in the state prior to water supply.

When the container in which the laundry is accommodated is rotated in the state prior to water supply, the laundry does not contain moisture, and thus an operation of the motor 200 may reach a steady state within a relatively short time. Thus, in the first current pattern Ip1, the steady state in which the maximum current value is maintained at a relatively constant value may be reached within a relatively short time.

With regard to the second current pattern Ip2, as described above, since the laundry contains moisture, the maximum current value may be reduced over time, and the steady state in which the maximum current value is maintained at a relatively constant value may be reached at a time point when the laundry is completely dried.

Even after the steady state is reached in the first current pattern Ip1 and the second current pattern Ip2, it may be seen that the average current value of the second current pattern Ip2 is higher than the average current value of the first current pattern Ip1. This is because a load applied to the motor 200 is increased due to the fact that the volume of laundry that is dried after being washed is larger in comparison to the volume of dry laundry that has not been washed, which results in higher current consumption.

As seen from FIGS. 4 and 5, when the weights of the laundry are 3 kg and 5 kg, similar results to the above case may also be achieved.

In consideration of the test results, the current setting value Is may be set to be higher than the maximum current value of the first current pattern Ip1. This is because, even after the steady state is reached in the first current pattern Ip1 and the second current pattern Ip2, the average current value and maximum current value of the second current pattern Ip2 are higher than the average current value and maximum current value of the first current pattern Ip1.

The current setting value Is may be appropriately determined within a range that satisfies a higher value than the maximum current value of the first current pattern Ip1. The current setting value Is may also be set to be higher than the maximum current value of the second current pattern Ip2 after the steady state is reached in the second current pattern Ip2.

The controller 100 may operate the motor 200 to perform the dry operation of laundry, and when the maximum current value of the second current pattern Ip2 is maintained at the current setting value Is or less, the operation of the motor 200 may be stopped and the dry operation of the laundry may be terminated.

As described above, at a time point when the operation of the motor 200 is stopped, the maximum current value of the second current pattern Ip2 may be higher than the maximum current value of the first current pattern Ip1.

The controller 100 may rotate the container in which the laundry is accommodated prior to water supply using the motor 200 in order to recognize the first current pattern Ip1, and may re-rotate the container for drying the laundry after water supply using the motor 200 in order to recognize the second current pattern Ip2. In this case, output of the motor 200 in the case in which the container is rotated prior to water supply and output of the motor 200 in the case in which the container is rotated for drying the laundry may be the same.

The current setting value Is may be derived via artificial intelligence model learning. Hereinafter, the artificial intelligence model will be described.

Artificial intelligence (AI) is an area of computer engineering science and information technology that studies methods to make computers mimic intelligent human behaviors such as reasoning, learning, self-improving, and the like.

In addition, artificial intelligence does not exist on its own, but is rather directly or indirectly related to a number of other fields in computer science. In recent years, there have been numerous attempts to introduce an element of the artificial intelligence into various fields of information technology to solve problems in the respective fields.

Machine learning is an area of artificial intelligence that includes the field of study that gives computers the capability to learn without being explicitly programmed.

Specifically, machine learning may be a technology for researching and constructing a system for learning, predicting, and improving its own performance based on empirical data and an algorithm for the same. Machine learning algorithms, rather than only executing rigidly set static program commands, may be used to take an approach that builds models for deriving predictions and decisions from inputted data.

Numerous machine learning algorithms have been developed for data classification in machine learning. Representative examples of such machine learning algorithms for data classification include a decision tree, a Bayesian network, a support vector machine (SVM), an artificial neural network (ANN), and so forth.

Decision tree refers to an analysis method that uses a tree-like graph or model of decision rules to perform classification and prediction.

Bayesian network may include a model that represents the probabilistic relationship (conditional independence) among a set of variables. Bayesian network may be appropriate for data mining via unsupervised learning.

SVM may include a supervised learning model for pattern detection and data analysis, heavily used in classification and regression analysis.

ANN is a data processing system modeled after the mechanism of biological neurons and interneuron connections, in which a number of neurons, referred to as nodes or processing elements, are interconnected in layers.

ANNs are models used in machine learning and may include statistical learning algorithms conceived from biological neural networks (particularly of the brain in the central nervous system of an animal) in machine learning and cognitive science.

ANNs may refer generally to models that have artificial neurons (nodes) forming a network through synaptic interconnections, and acquires problem-solving capability as the strengths of synaptic interconnections are adjusted throughout training.

The terms 'artificial neural network' and 'neural network' may be used interchangeably herein.

An ANN may include a number of layers, each including a number of neurons. Furthermore, the ANN may include synapses that connect the neurons to one another.

An ANN may be defined by the following three factors: (1) a connection pattern between neurons on different layers; (2) a learning process that updates synaptic weights; and (3) an activation function generating an output value from a weighted sum of inputs received from a lower layer.

ANNs include, but are not limited to, network models such as a deep neural network (DNN), a recurrent neural network (RNN), a bidirectional recurrent deep neural network (BRDNN), a multilayer perception (MLP), and a convolutional neural network (CNN).

An ANN may be classified as a single-layer neural network or a multi-layer neural network, based on the number of layers therein.

In general, a single-layer neural network may include an input layer and an output layer.

In general, a multi-layer neural network may include an input layer, one or more hidden layers, and an output layer.

The input layer receives data from an external source, and the number of neurons in the input layer is identical to the number of input variables. The hidden layer is located between the input layer and the output layer, and receives signals from the input layer, extracts features, and feeds the extracted features to the output layer. The output layer receives a signal from the hidden layer and outputs an output value based on the received signal. Input signals between the neurons are summed together after being multiplied by corresponding connection strengths (synaptic weights), and if this sum exceeds a threshold value of a corresponding neuron, the neuron may be activated and output an output value obtained through an activation function.

A deep neural network with a plurality of hidden layers between the input layer and the output layer may be the most representative type of artificial neural network which enables deep learning, which is one machine learning technique.

An ANN may be trained using training data. Here, the training may refer to the process of determining parameters of the artificial neural network by using the training data, to perform tasks such as classification, regression analysis, and clustering of inputted data. Such parameters of the artificial neural network may include synaptic weights and biases applied to neurons.

An artificial neural network trained using training data may classify or cluster inputted data according to a pattern within the inputted data.

Throughout the present specification, an artificial neural network trained using training data may be referred to as a trained model.

Hereinbelow, learning paradigms of an artificial neural network will be described in detail.

Learning paradigms, in which an artificial neural network operates, may be classified into supervised learning, unsupervised learning, semi-supervised learning, and reinforcement learning.

Supervised learning is a machine learning method that derives a single function from the training data.

Among the functions that may be thus derived, a function that outputs a continuous range of values may be referred to as a regression, and a function that predicts and outputs the class of an input vector may be referred to as a classifier.

In supervised learning, an artificial neural network may be trained with training data that has been given a label.

Here, the label may refer to a target answer (or a result value) to be guessed by the artificial neural network when the training data is inputted to the artificial neural network.

Throughout the present specification, the target answer (or a result value) to be guessed by the artificial neural network when the training data is inputted may be referred to as a label or labeling data.

Throughout the present specification, assigning one or more labels to training data in order to train an artificial neural network may be referred to as labeling the training data with labeling data.

Training data and labels corresponding to the training data together may form a single training set, and as such, they may be inputted to an artificial neural network as a training set.

The training data may exhibit a number of features, and the training data being labeled with the labels may be interpreted as the features exhibited by the training data being labeled with the labels. In this case, the training data may represent a feature of an input object as a vector.

Using training data and labeling data together, the artificial neural network may derive a correlation function between the training data and the labeling data. Then, through evaluation of the function derived from the artificial neural network, a parameter of the artificial neural network may be determined (optimized).

Unsupervised learning is a machine learning method that learns from training data that has not been given a label.

More specifically, unsupervised learning may be a training scheme that trains an artificial neural network to discover a pattern within given training data and perform classification by using the discovered pattern, rather than by using a correlation between given training data and labels corresponding to the given training data.

Examples of unsupervised learning include, but are not limited to, clustering and independent component analysis.

Examples of artificial neural networks using unsupervised learning include, but are not limited to, a generative adversarial network (GAN) and an autoencoder (AE).

GAN is a machine learning method in which two different artificial intelligences, a generator and a discriminator, improve performance through competing with each other.

The generator may be a model generating new data that generates new data based on true data.

The discriminator may be a model recognizing patterns in data that determines whether inputted data is from the true data or from the new data generated by the generator.

Furthermore, the generator may receive and learn from data that has failed to fool the discriminator, while the discriminator may receive and learn from data that has succeeded in fooling the discriminator. Accordingly, the generator may evolve so as to fool the discriminator as effectively as possible, while the discriminator evolves so as to distinguish, as effectively as possible, between the true data and the data generated by the generator.

An auto-encoder (AE) is a neural network which aims to reconstruct its input as output.

More specifically, AE may include an input layer, at least one hidden layer, and an output layer.

Since the number of nodes in the hidden layer is smaller than the number of nodes in the input layer, the dimensionality of data is reduced, thus leading to data compression or encoding.

Furthermore, the data outputted from the hidden layer may be inputted to the output layer. Given that the number of nodes in the output layer is greater than the number of nodes in the hidden layer, the dimensionality of the data increases, thus leading to data decompression or decoding.

Furthermore, in the AE, the inputted data is represented as hidden layer data as interneuron connection strengths are adjusted through training. The fact that when representing information, the hidden layer is able to reconstruct the inputted data as output by using fewer neurons than the input layer may indicate that the hidden layer has discovered a hidden pattern in the inputted data and is using the discovered hidden pattern to represent the information.

Semi-supervised learning is machine learning method that makes use of both labeled training data and unlabeled training data.

One semi-supervised learning technique involves reasoning the label of unlabeled training data, and then using this reasoned label for learning. This technique may be used advantageously when the cost associated with the labeling process is high.

Reinforcement learning may be based on a theory that given the condition under which a reinforcement learning agent may determine what action to choose at each time instance, the agent may find an optimal path to a solution solely based on experience without reference to data.

Reinforcement learning may be performed mainly through a Markov decision process.

Markov decision process consists of four stages: first, an agent is given a condition containing information required for performing a next action; second, how the agent behaves in the condition is defined; third, which actions the agent should choose to get rewards and which actions to choose to get penalties are defined; and fourth, the agent iterates until future reward is maximized, thereby deriving an optimal policy.

An artificial neural network is characterized by features of its model, the features including an activation function, a loss function or cost function, a learning algorithm, an optimization algorithm, and so forth. Also, the hyperparameters are set before learning, and model parameters may be set through learning to specify the architecture of the artificial neural network.

For instance, the structure of an artificial neural network may be determined by a number of factors, including the number of hidden layers, the number of hidden nodes included in each hidden layer, input feature vectors, target feature vectors, and so forth.

Hyperparameters may include various parameters which need to be initially set for learning, much like the initial values of model parameters. Also, the model parameters may include various parameters sought to be determined through learning.

For instance, the hyperparameters may include initial values of weights and biases between nodes, mini-batch size, iteration number, learning rate, and so forth. Furthermore, the model parameters may include a weight between nodes, a bias between nodes, and so forth.

Loss function may be used as an index (reference) in determining an optimal model parameter during the learning process of an artificial neural network. Learning in the artificial neural network involves a process of adjusting model parameters so as to reduce the loss function, and the purpose of learning may be to determine the model parameters that minimize the loss function.

Loss functions typically use means squared error (MSE) or cross entropy error (CEE), but the present disclosure is not limited thereto.

Cross-entropy error may be used when a true label is one-hot encoded. One-hot encoding may include an encoding method in which among given neurons, only those corresponding to a target answer are given 1 as a true label value, while those neurons that do not correspond to the target answer are given 0 as a true label value.

In machine learning or deep learning, learning optimization algorithms may be deployed to minimize a cost function, and examples of such learning optimization algorithms include gradient descent (GD), stochastic gradient descent (SGD), momentum, Nesterov accelerate gradient (NAG), Adagrad, AdaDelta, RMSProp, Adam, and Nadam.

GD includes a method that adjusts model parameters in a direction that decreases the output of a cost function by using a current slope of the cost function.

The direction in which the model parameters are to be adjusted may be referred to as a step direction, and a size by which the model parameters are to be adjusted may be referred to as a step size.

Here, the step size may mean a learning rate.

GD obtains a slope of the cost function through use of partial differential equations, using each of model parameters, and updates the model parameters by adjusting the model parameters by a learning rate in the direction of the slope.

SGD may include a method that separates the training dataset into mini batches, and by performing gradient descent for each of these mini batches, increases the frequency of gradient descent.

Adagrad, AdaDelta and RMSProp may include methods that increase optimization accuracy in SGD by adjusting the step size, and may also include methods that increase optimization accuracy in SGD by adjusting the momentum and step direction. Adam may include a method that combines momentum and RMSProp and increases optimization accuracy in SGD by adjusting the step size and step direction. Nadam may include a method that combines NAG and RMSProp and increases optimization accuracy by adjusting the step size and step direction.

Learning rate and accuracy of an artificial neural network rely not only on the structure and learning optimization algorithms of the artificial neural network but also on the hyperparameters thereof. Therefore, in order to obtain a good learning model, it is important to choose a proper structure and learning algorithms for the artificial neural network, but also to choose proper hyperparameters.

In general, the artificial neural network is first trained by experimentally setting hyperparameters to various values, and based on the results of training, the hyperparameters may be set to optimal values that provide a stable learning rate and accuracy.

The controller 100 may be connected to the processor 500 for deriving the current setting value Is of the motor 200. The processor 500 may perform learning according to the artificial intelligence model, and may receive an input factor and derive the current setting value Is using the received input factor.

The processor 500 may include the artificial neural network, may receive an input factor, and may learn an artificial intelligence model based on the input factor to derive the current setting value Is.

Input factors may include the output of the motor 200, the weight of laundry accommodated in the container, and the first current pattern Ip1 in the state prior to water supply.

The washing apparatus may further include a transceiver for communicating with a server, and the controller 100 may communicate with the server through the transceiver.

The server may store an artificial intelligence model and may also store data required for training the artificial intelligence model. Further, the server may evaluate the artificial intelligence model and may update the artificial intelligence model for better performance even after evaluation.

The transceiver may be configured to include at least one of a mobile communication module and a wireless internet module. In addition, the transceiver may further include a short-range communication module.

The mobile communication module may transmit and receive wireless signals to and from at least one of a base station, an external terminal, and a server on a mobile communication network established according to technical standards or communication methods for mobile communications, for example, global system for mobile communication (GSM), code division multi access (CDMA), code division multi access 2000 (CDMA2000), enhanced voice-data optimized or enhanced voice-data only (EV-DO), wide-band CDMA (WCDMA), high speed downlink packet access (HSDPA), high speed uplink packet access (HSUPA), long term evolution (LTE), long term evolution-advanced (LTE-A), 5th generation (5G) communication, and the like.

The wireless internet module refers to a module for wireless internet access, and may be included in a vehicle. The wireless internet module may transmit and receive wireless signals via a communication network according to wireless internet technologies.

The vehicle may transmit/receive data to/from a server and various terminals that may perform communication through a 5G network. In particular, the vehicle may perform data communication with a server and a terminal using at least one service of enhanced mobile broadband (eMBB), ultra-reliable and low latency communications (URLLC), and massive machine-type communications (mMTC) through a 5G network.

eMBB is a mobile broadband service, and provides, for example, multimedia contents and wireless data access. In addition, improved mobile services such as hotspots and broadband coverage for accommodating the rapidly growing mobile traffic may be provided via eMBB. Through a hotspot, high-volume traffic may be accommodated in an area where user mobility is low and user density is high. Through broadband coverage, a wide-range and stable wireless environment and user mobility may be guaranteed.

The URLLC service defines the requirements that are far more stringent than existing LTE in terms of reliability and transmission delay of data transmission and reception, and corresponds to a 5G service for production process automation in the industrial field, telemedicine, remote surgery, transportation, safety, and the like.

mMTC is a transmission delay-insensitive service that requires a relatively small amount of data transmission. mMTC enables a much larger number of terminals, such as sensors, than general mobile cellular phones to be simultaneously connected to a wireless access network. In this case, the communication module price of the terminal should be inexpensive, and there is a need for improved power efficiency and power saving technology capable of operating for years without battery replacement or recharging.

The processor 500 may be included in the server. The server may receive data of the input factor from the washing apparatus, and the processor 500 may perform artificial intelligence model learning based on the received data to derive required current setting values Is.

The controller 100 may receive information on the current setting values Is from the server. The controller 100 may receive information on the current setting values Is for respective conditions, which are derived via artificial intelligence model learning of the processor 500, from the server.

Here, the respective conditions may refer to conditions depending on a change in at least one of the input factors, that is, the output of the motor 200, the weight of laundry accommodated in the container, or the first current pattern Ip1 in the state prior to water supply.

Based on the received information on the current setting values Is, the controller 100 may stop the operation of the motor 200 and may terminate the dry operation of laundry when the maximum current value of the second current pattern Ip2 is maintained at the current setting value Is or less for each respective condition.

Figure 6:
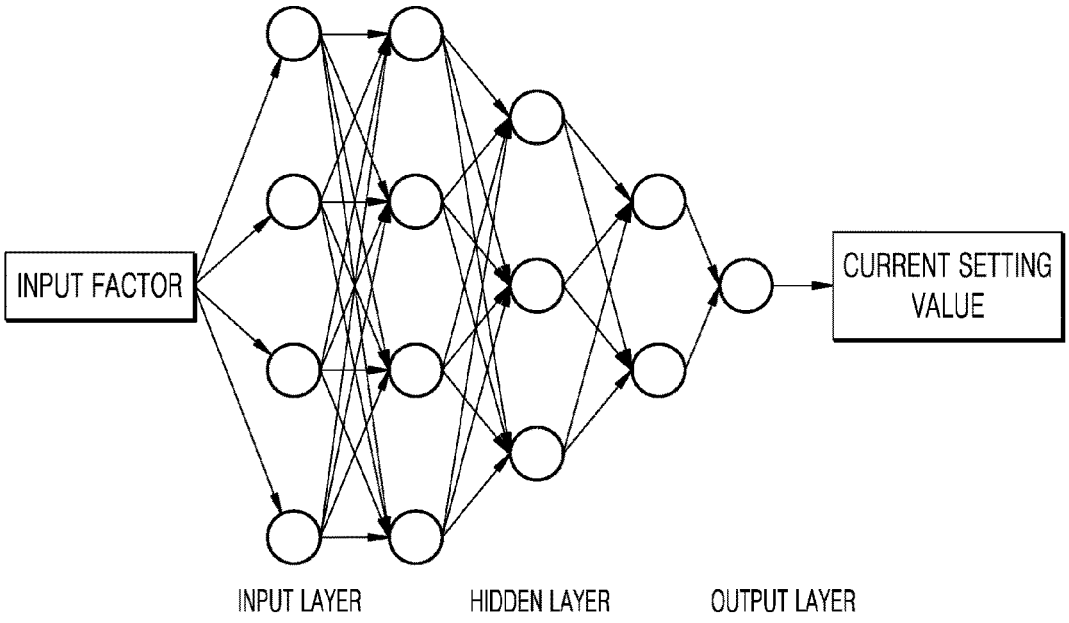
FIG. 6 is a diagram for explaining an artificial neural network according to an embodiment.

FIG. 6 is a diagram for explaining an artificial neural network according to an embodiment. The artificial neural network may be included in the processor 500, and the processor 500 may learn the artificial intelligence model through the artificial neural network.

The current setting values Is may be values derived based on conditions depending on a change in at least one of the output of the motor 200, the weight of the laundry, or the first current pattern Ip1 in the state prior to water supply in a learning mode according to the artificial intelligence model.

When a condition changes, the derived current setting value Is may also change. Different current setting values Is may be derived for the respective conditions via artificial intelligence model learning.

The artificial intelligence model learning may be performed by an artificial neural network including an input layer to which an input factor is inputted, an output layer for deriving the current setting value Is, and a plurality of hidden layers between the input layer and the output layer.

The processor 500 may receive an input factor, may perform the artificial intelligence model learning based on the received input factor, and may derive the current setting value Is that satisfies a condition for terminating the dry operation of laundry.

As described above, the input factors may include the output of the motor 200, the weight of laundry accommodated in the container, and the first current pattern Ip1 in the state prior to water supply. In addition, the input factors may further include other factors that affect the current setting values Is.

When input factors of different conditions are inputted to the artificial neural network, the processor 500 may learn the artificial intelligence model and may derive the current setting values Is corresponding to the respective conditions.

For example, when RNN is used as the artificial intelligence learning model, input factors of different conditions may be sequentially inputted to the artificial neural network at different time points, combination and calculation of the input factors may be performed in the hidden layer, and the current setting values Is that are required in different conditions of the input factors may be derived.

Referring back to FIG. 1, the washing apparatus may further include the memory 600 for storing information on the current setting value Is. The current setting value Is may be a value obtained by learning input factors in different conditions through the processor 500. That is, the current setting value Is derived by the processor 500 may be stored in the memory 600.

The controller 100 may select the current setting value Is based on information on the current setting values Is stored in the memory 600. The memory 600 may store the respective current setting values Is for the different conditions of the input factors.

Thus, the controller 100 may select the current setting value Is corresponding to the output of the motor 200, the weight of laundry accommodated in the container, and the first current pattern Ip1 in the state prior to water supply based on the information stored in the memory, and may perform the dry operation of laundry by controlling the motor 200 based on the selected current setting value Is.

According to embodiments, the processor 500 may train the artificial intelligence model whenever the washing apparatus performs washing and drying, and may update the information on the input factors and the current setting value Is, which change depending on the learning result, in the memory 600.

In order to derive the current setting value Is via artificial intelligence model learning, the processor 500 needs to classify and cluster first current patterns Ip1 having various shapes into several classifications.

In addition, when there is a new first current pattern Ip1, an operation of including the new first current pattern Ip1 in any one of existing classifications of first current patterns, based on the classified and clustered data on the first current patterns Ip1, is required.

The processor 500 may perform learning regarding classification of the new first current pattern Ip1 according to the artificial intelligence model. That is, the accuracy of classification of the new first current pattern Ip1 may be improved via artificial intelligence model learning. For example, the learning may be performed through meta learning.

Figure 7:
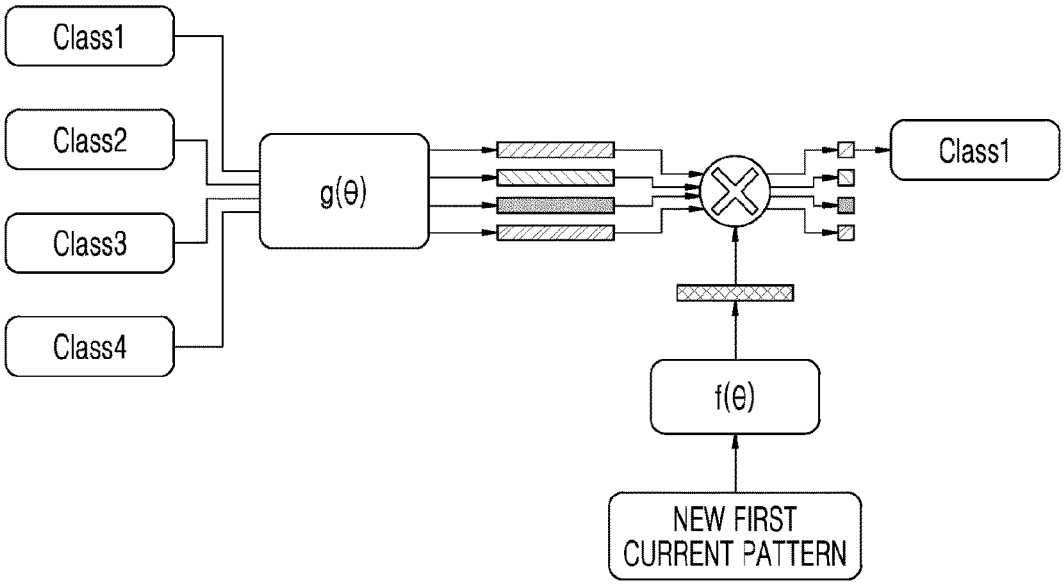
FIG. 7 is a diagram for explaining learning according to an artificial intelligence model according to an embodiment.

FIG. 7 is a diagram for explaining learning according to an artificial intelligence model according to an embodiment. Hereinafter, with reference to FIG. 7, meta learning for classifying the new first current pattern Ip1 will be described.

For example, the features of each class may be extracted from a first current pattern Ip1 classified into Class 1 to Class 4 using an embedding function (g(θ)). The function g(θ) may convert category type data on the first current pattern Ip1 to a continuous vector form.

The function f(θ) may cluster the feature of the first current pattern Ip1 represented by a function g(θ). The function f(θ) may determine a class to which the new first current pattern Ip1 inputted to an artificial neural network belongs based on the feature of each of the clustered classes.

As such, the artificial neural network may perform classification to determine a class to which the new first current pattern Ip1 belongs using the functions f(θ) and g(θ). In FIG. 7, as the result of meta learning, the new first current pattern Ip1 may be classified into Class 1.

Figure 8:
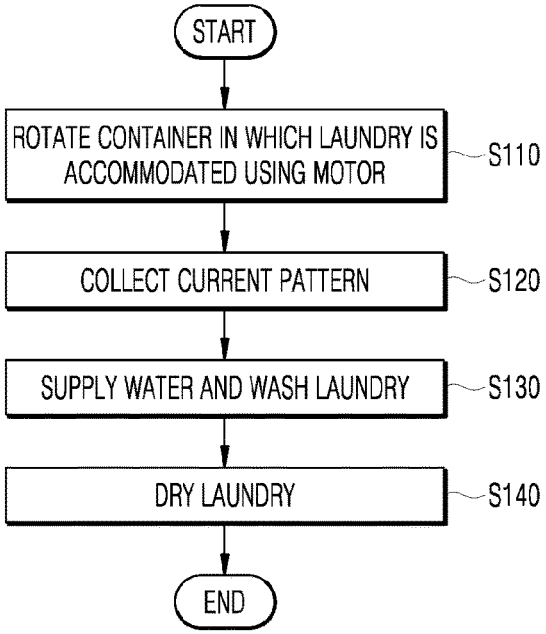
FIG. 8 is a flowchart for explaining a control method of a washing apparatus according to an embodiment.

FIG. 8 is a flowchart for explaining a control method of a washing apparatus according to an embodiment.

The controller 100 may operate the motor 200, and may rotate a container in which laundry is accommodated using the motor 200 (S110). In this case, the laundry is not washed, and thus water is not supplied to the laundry, and the laundry does not contain moisture.

An operating time of the motor 200 may be appropriately set within a range capable of verifying the first current pattern Ip1 in a relatively constant form after the motor 200 reaches a steady state.

The controller 100 may collect a current pattern indicating a changing trend of the current value of the motor 200 over time, that is, the first current pattern Ip1 (S120).

Water may be supplied to the container and the laundry may be washed (S130).

After washing is completed, wet laundry may be dried (S140). When the dried state of the laundry satisfies the set condition, the controller 100 may stop an operation of the motor 200 and may terminate the dry operation of the laundry. As described above, the set condition may indicate a state in which the current value of the motor 200 is maintained at the current setting value Is or less.

The set condition for the dried state of the laundry may be derived by learning according to an artificial intelligence model based on the output and current pattern of the motor 200, and the weight of the laundry.

The controller 100 may be connected to the processor 500 that derives the current setting value Is of the motor 200. The processor 500 may perform learning according to the artificial intelligence model, and may receive the input factor and derive the current setting value Is using the received input factor.

The input factors may be the output of the motor 200, the weight of laundry accommodated in the container, and the first current pattern Ip1 in the state prior to water supply.

The controller 100 may stop an operation of the motor 200 and may terminate the dry operation of the laundry when the maximum current value of the second current pattern Ip2 is maintained at the current setting value Is or less.

At a time point when the operation of the motor 200 is stopped, the maximum current value of the second current pattern Ip2 may be higher than the maximum current value of the first current pattern Ip1.

The output of the motor 200 in the case in which the container is rotated prior water supply and the output of the motor 200 in the case in which the container is rotated for drying the laundry may be the same.

The aforementioned artificial intelligence model learning for deriving the current setting value Is may be performed simultaneously with an operation of the washing apparatus during a washing and driving procedure of the washing apparatus.

The washing apparatus and the control method thereof according to embodiments may also be applied in a similar way to a laundry drier without a water supply and washing function.

In the case of the laundry drier, wet laundry that is completely washed may be moved to the laundry drier, a dry operation may be performed, and the current setting value Is required for the dry operation may be derived via artificial intelligence model learning.

In the case of the laundry drier, operation 8130 may not be performed.

According to embodiments of the present disclosure, the dry operation of the laundry may be controlled using the current setting value Is derived via artificial intelligence model learning, and thus convenience of the dry operation of the laundry may be enhanced compared with the case in which a separate humidity sensor is used.

According to the embodiments, in order to recognize a dried state of the laundry, it is not required to use a separate humidity sensor, and thus costs may be advantageously reduced.

When the separate humidity sensor is used, a dried state of the laundry differs and may be inaccurately recognized depending on an arrangement position of the humidity sensor, but since in the present disclosure the dried state of the laundry may be recognized via artificial intelligence model learning, the accuracy of the dry operation of the laundry may be enhanced.

As described above in association with embodiments, although some cases were described, other various embodiments are possible. The technical contents of the embodiments described above may be combined in various ways unless they are not compatible, so new embodiments may be correspondingly implemented.

What is claimed is:

1. A washing apparatus having a container in which laundry is accommodated, the washing apparatus comprising:

at least one controller;

a motor electrically connected to the at least one controller and configured to rotate the container;

a weight sensor electrically connected to the at least one controller and configured to measure a weight of the laundry accommodated in the container; and a current sensor electrically connected to the at least one controller and configured to measure a value of a current applied to the motor, wherein the at least one controller is configured to stop an operation of the motor and terminate a dry operation of the laundry based on a value of a factor for checking a state of dryness of the laundry satisfying a preset value of the factor, wherein the value of the factor for checking the state of dryness of the laundry is measured by at least one of the weight sensor or the current sensor, or recognized by the controller, and wherein the preset value of the factor is derived via learning according to an artificial intelligence model based on an output of the motor, a changing trend of the value of the current applied to the motor over time, and the weight of the laundry.

2. The washing apparatus of claim 1, wherein the preset value of the factor is a preset value of the current applied to the motor.

3. The washing apparatus of claim 2, wherein the at least one controller is connected to at least one processor configured to derive the preset value of the current applied to the motor, and wherein the at least one processor is further configured to perform learning according to the artificial intelligence model, receive an input factor and derive the preset value of the current applied to the motor using the received input factor.

4. The washing apparatus of claim 3, wherein the input factor comprises the output of the motor, the weight of the laundry accommodated in the container, and a first current pattern defined as a current pattern of the motor when the container is rotated, in a state prior to water supply.

5. The washing apparatus of claim 4, wherein the preset value of the current applied to the motor is a value derived based on a condition depending on a change in at least one of the output of the motor, the weight of the laundry, or the first current pattern in the state prior to water supply in a learning mode according to the artificial intelligence model.

6. The washing apparatus of claim 4, wherein the preset value of the current applied to the motor is set to be higher than a maximum current value of the first current pattern.

7. The washing apparatus of claim 4, wherein the at least one controller is further configured to stop the operation of the motor and terminate the dry operation of the laundry when a maximum current value of a second current pattern is maintained at the preset value of the current applied to the motor or less, wherein the second current pattern is defined as a current pattern of the motor when the container is rotated for drying the laundry, in a state after the water supply.

8. The washing apparatus of claim 7, wherein the maximum current value of the second current pattern is higher than a maximum current value of the first current pattern at a time point at which the operation of the motor is stopped.

9. The washing apparatus of claim 7, wherein the output of the motor when the container is rotated prior to the water supply is same as the output of the motor when the container is rotated for drying the laundry.

10. The washing apparatus of claim 4, wherein the at least one processor is further configured to perform learning on classification of a new first current pattern according to the artificial intelligence model.

11. The washing apparatus of claim 3, further comprising a transceiver configured to communicate with a server, wherein the at least one processor is included in the server.

12. The washing apparatus of claim 11, wherein the at least one controller is further configured to receive information on the preset value of the current applied to the motor from the server.

13. The washing apparatus of claim 3, further comprising a memory configured to store information on the preset value of the current applied to the motor, wherein the at least one controller is further configured to select the preset value of the current applied to the motor based on the stored information on the preset value of the current applied to the motor.

* * * * *